US007014971B2

(12) United States Patent
Skorokhod et al.

(10) Patent No.: US 7,014,971 B2
(45) **Date of Patent: *Mar. 21, 2006**

(54) CARRIER COMPOSITIONS

(75) Inventors: Vladislav Skorokhod, Mississauga (CA); Wafa F. Bashir, Mississauga (CA); Richard P. N. Veregin, Mississauga (CA); Michael S. Hawkins, Cambridge (CA); Deepak R. Maniar, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 107 days.

This patent is subject to a terminal disclaimer.

(21) Appl. No.: 10/384,901

(22) Filed: Mar. 7, 2003

(65) Prior Publication Data

US 2004/0180281 A1 Sep. 16, 2004

(51) Int. Cl.
*G03G 9/10* (2006.01)

(52) U.S. Cl. ..... 430/111.32; 430/111.31; 430/111.35; 430/111.41

(58) Field of Classification Search ..... 430/111.1, 430/111.3, 111.32, 111.35, 111.41
See application file for complete search history.

(56) References Cited

U.S. PATENT DOCUMENTS

| | | | | |
|---|---|---|---|---|
| 3,839,029 | A * | 10/1974 | Berg et al. | 430/111.3 |
| 4,233,387 | A | 11/1980 | Mammino et al. | 430/137 |
| 4,264,697 | A * | 4/1981 | Perez et al. | 430/111.35 |
| 4,855,205 | A * | 8/1989 | Saha et al. | 430/111.33 |
| 4,912,005 | A * | 3/1990 | Goodman et al. | 430/111.32 |
| 5,015,550 | A | 5/1991 | Creatura et al. | 430/108 |
| 5,236,629 | A | 8/1993 | Mahabadi et al. | 252/511 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,370,963 | A | 12/1994 | Patel et al. | 430/137 |
| 5,518,855 | A | 5/1996 | Creatura et al. | 430/137 |
| 5,998,076 | A | 12/1999 | Mahabadi et al. | 430/106.6 |
| 6,004,712 | A | 12/1999 | Barbetta et al. | 430/108 |
| 6,358,659 | B1 | 3/2002 | Foucher et al. | 430/111.35 |
| 6,511,780 | B1 | 1/2003 | Veregin et al. | 430/111.35 |
| 6,528,225 | B1 | 3/2003 | Mahabadi et al. | 430/111.33 |

FOREIGN PATENT DOCUMENTS

JP 62035369 A * 2/1987

* cited by examiner

*Primary Examiner*—Christopher Rodee
(74) *Attorney, Agent, or Firm*—Eugene O. Palazzo; Fay, Sharpe, Fagan, Minnich & McKee, LLP

(57) ABSTRACT

Carrier comprised of a mixture of a first carrier and a second carrier, and wherein the first carrier is comprised of a steel core and the second carrier is comprised of a magnetite.

20 Claims, No Drawings

CARRIER COMPOSITIONS

RELATED PATENTS AND COPENDING APPLICATIONS

Illustrated in U.S. Pat. No. 6,511,780 and copending application U.S. Ser. No. 09/037,555, the disclosures of which are totally incorporated herein by reference, are, for example, carrier particles comprised of a mixture of insulating carrier particles and conductive carrier particles.

Illustrated in copending application U.S. Ser. No. 09/037,555, and U.S. Pat. No. 5,998,076, the disclosures of which are totally incorporated herein by reference, are, for example, a carrier comprised of a soft or hard magnetic core, a number of or all of the pores thereof being filled with polymer, and thereover a coating and a carrier comprised of a porous hard magnetic core, and wherein the pores thereof are filled with a polymer and which carrier contains a coating thereover of a polymer, or a polymer mixture. Also, illustrated in U.S. Pat. No. 6,004,712, the disclosure of which is totally incorporated herein by reference, are carriers, coated carriers, and developers thereof. The carrier coatings of the above applications and patents may contain a conductive component, such as carbon black therein.

Illustrated in U.S. Pat. No. 6,358,659, the disclosure of which is totally incorporated herein by reference, is, for example, a carrier comprised of a core and thereover a polymer, and wherein the polymer contains a conductive polymer dispersed therein.

Illustrated in copending application U.S. Ser. No. 09/640,601, the disclosure of which is totally incorporated herein by reference, is, for example, a carrier comprised of a core, a polymer coating and wherein the coating contains a conductive polymer.

The appropriate components, processes and the like of the above patents and pending applications may be selected for the present invention in embodiments thereof.

BACKGROUND

This invention is generally directed to developer compositions, and more specifically, the present invention relates to developer compositions containing carriers. In embodiments of the present invention the carrier particles are comprised of a mixture of a first carrier comprised, for example, of an iron core, such as an iron powder core available from Hoeganaes Corporation as an "atomized steel powder", and referred to as a "steel core", especially a rough core, that is a core with a nonsmooth surface, and a second carrier comprised of a spherical magnetite core and embodiments wherein each of the cores can be of a similar size diameter. The second carrier core in amounts, for example, of from about 10 to about 30 weight percent, primarily functions to increase the developed mass per unit area (DMA) of a solid image by up to about 80 percent, and more specifically, from about 30 to about 65 percent compared to the use of a rough steel core, permits an excellent optical density increase of the obtained solid image by approximately the same factor as the DMA developability characteristics of developers within which it is contained, and permits improvements development stability in low throughput aging (for example, prolonged such as for 100 cycles, and more specifically, from about 100 to about 1,000 cycles at a low, about for example 5 percent, area coverage corresponding to a full page of text). The first steel cores rough morphology primarily maintains the conductivity of the developer at, for example, from about $10^{-8}$ to about $10^{-7}$ (ohm-cm)$^{-1}$ as measured by known methods, such as determined in a magnetic brush cell at 10 volts. Conductivity of a developer of carrier and toner in a donor roll development system is preferably maintained at least from about $10^{-9}$ (ohm-cm)$^{-1}$ to about $10^{-4}$ (ohm-cm)$^{-1}$ to provide sufficient toner reload on the donor roll. Deficient reload appears upon printing large solid area images as fading of the solid or half-tone area after one full revolution of the donor roll. Typically, an increase of lightness (L*) by 3 or less is permitted in reloaded solid area. Changes of L* by greater than 3 are visible to a naked eye, and thus constitute a print defect. More specifically, in embodiments the carrier particles can be generated from a mixture of a spherical carrier and a rough carrier, the spherical carrier being comprised of a magnetite core and a rough carrier comprised of a steel core as illustrated herein, inclusive of mixtures of coated spherical and coated rough carriers, and note that the rough carrier is conductive primarily due to its rough morphology. The pure carriers in embodiments can possess close conductivities of, for example, about $10^{-8}$ to about $10^{-7}$ for rough steel and from about $10^{-9}$ to about $10^{-8}$ for magnetite. However, developer conductivity falls with TC much faster with the spherical carrier than with a rough carrier core. For example, the conductivity of a developer comprising a rough steel or spherical magnetite carrier with an average particle size of 65 micrometers and toner with an average particle size of 5.6 micrometers at a toner concentration (TC) of 0 percent (carrier only), 1 percent and 4.5 percent. With rough carrier, developer conductivity was $9\times10^{-8}$ (ohm-cm)$^{-1}$, $1.1\times10^{-8}$ (ohm-cm)$^{-1}$ and $3.2\times10^{-12}$ (ohm-cm)$^{-1}$, respectively; when the developer was comprised of a spherical carrier, developer conductivity was $3.4\times10^{-8}$ (ohm-cm)$^{-1}$, $4.9\times10^{-10}$ (ohm-cm)$^{-1}$ and $1\times10^{-14}$ (ohm-cm)$^{-1}$, respectively. Thus, for example, there can be provided in accordance with aspects of the present invention developers with a conductivity of from about $10^{-6}$ to about $10^{-15}$ (ohm-cm)$^{-1}$, and yet more specifically, wherein the developers can possess semiconductive or moderately conductive such as from about $10^{-8}$ to about $10^{-11}$ (ohm-cm)$^{-1}$ characteristics, that is wherein the conductivity of the carrier particles are in between conductive and insulative carriers, and more specifically, wherein semiconductive refers, for example, to a carrier with a conductivity of from about $10^{-9}$ to about $10^{-13}$ (ohm-cm)$^{-1}$. The carriers of the present invention may be mixed with a toner of resin, colorant, and optional toner additives, and more specifically, toners generated by known emulsion/aggregation processes, and wherein the toner volume average diameter can vary, for example; the diameter can be from about 2 to about 25 microns, and more specifically, from about 4 to about 7 microns, and yet more specifically, from about 5 to about 6 microns, to provide developers that can be selected for the development of images in electrostatographic, especially xerographic, imaging systems, printing processes, digital systems, more specifically hybrid development, reference for example, U.S. Pat. No. 5,032,872, the disclosure of which is totally incorporated herein by reference.

Examples of carriers in embodiments of the present invention include those comprised of a suitable carrier core as illustrated herein, and a polymer thereover, such as polymethylmethacrylate (PMMA), polyvinylidenefluoride, polyethylene, copolyethylene vinylacetate, copolyvinylidenefluoride tetrafluoroethylene, polystyrene, polytetrafluoroethylene, polyvinylchloride, polyvinylfluoride, polylbutylacrylate, copolybutylacrylate methacrylate, polytrifluoroethylmethacrylate, polyurethanes, and mixtures thereof, especially a mixture of two polymers. Conductive carrier mixtures can also include a suitable carrier core, a polymer thereover and a conductive component, such as a conductive carbon black dispersed in the polymer coating.

Advantages of the carrier mixtures of the present invention in embodiments include controlling and preselecting the triboelectric charge and conductivity of the carrier, the formation of homogenous mixtures, excellent carrier coating adherence, stable charging characteristics, carrier design flexibility and freedom, economical carrier formation, increased developability, development stability to low throughput aging, developer conductivity at high levels of about $10^{-10}$ to about $10^{-8}$, excellent stable charging characteristics, and the like.

REFERENCES

Carriers with a coating of a conductive polymethylmethacrylate (PMMA) and insulating PMMA are illustrated in U.S. Pat. No. 5,518,855, the disclosure of which is totally incorporated herein by reference, carriers containing a mixture of polymers, especially two polymers not in close proximity in the triboelectric series, are illustrated in U.S. Pat. No. 5,015,550, the disclosure of which is totally incorporated herein by reference. The appropriate components, such as the polymer coatings and processes of the U.S. Pat. No. 5,015,550 patent, can be selected for the present invention in embodiments thereof.

Developer compositions with coated carriers that contain conductive components like carbon black are known. Disadvantages associated with these carriers may be that the carbon black can increase the brittleness of the polymer matrix, which causes the separation of the coating from the core, and thereby contaminates the toner and developer causing, for example, instabilities in the charging level of the developer as a function of a number of factors, such as the developer age in the xerographic housing and the average toner area coverage of a printed page, or instabilities in the color gamut of the developer set. In addition, with carbon black it is difficult to tune, or pre-select the carrier conductivity. These and other disadvantages are avoided, or minimized with the carriers of the present invention in embodiments thereof.

The conductivity of carbon blacks is generally independent of the type of carbon black used, and in carbon black composites there is usually formed a filamentary network above a certain concentration, referred to as the "percolation" threshold. At concentrations of up to about 30 weight percent, conductivities of $10^{-2}$ $(\text{ohm-cm})^{-1}$ have been reported. The resistivity thereof, measured with a standard 4-pin method according to ASTM-257, is observed to increase with decreasing carbon black concentration.

Carrier particles for use in the development of electrostatic latent images are illustrated in many patents including, for example, U.S. Pat. No. 3,590,000, the disclosure of which is totally incorporated herein by reference. These carrier particles may contain various cores, including steel, with a coating thereover of fluoropolymers, or terpolymers of styrene, methacrylate, and silane compounds. Recent efforts have focused on the attainment of coatings for carrier particles for the primary purpose of improving development quality; and also to permit carrier particles that can be recycled, and which do not adversely effect the imaging member in any substantial manner. Some of the present commercial coatings can deteriorate, especially when selected for a continuous xerographic process where the entire coating may separate from the carrier core in the form of chips or flakes, and fail upon impact, or abrasive contact with machine parts and other carrier particles. These flakes or chips, which are not generally reclaimed from the developer mixture, can have an adverse effect on the triboelectric charging characteristics of the carrier particles thereby providing images with lower resolution in comparison to those compositions wherein entire carrier coatings are retained on the surface of the core substrate. Further, another problem encountered with some prior art carrier coatings resides in fluctuating triboelectric charging characteristics, particularly with changes in relative humidity. The aforementioned modifications in triboelectric charging characteristics provide developed images of lower quality, and with background deposits.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from about 30 microns to about 1,000 microns, with from about 0.05 percent to about 3 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of about 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not believed to be constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, in embodiments thereof, the conductivity of the resulting carrier particles are substantially constant, and moreover, the triboelectric values can be selected to vary significantly, for example from less than about 80 microcoulombs per gram to greater than about −80 microcoulombs per gram, depending on the polymer mixture selected for affecting the coating processes.

Carriers obtained by applying insulating resinous coatings to porous metallic carrier cores using solution coating techniques can be undesirable from many viewpoints. For example, insufficient coating material may be present, and therefore, is not as readily available for triboelectric charging when the coated carrier particles are mixed with finely divided toner particles. Attempts to resolve this problem by increasing the carrier coating weights, for example, to 3 percent or greater to provide a more effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are low for many uses. Powder coating processes have been utilized to overcome these disadvantages, and further to enable developer mixtures that are capable of generating high and useful triboelectric charging values with finely divided toner particles; and also wherein the carrier particles are of substantially constant conductivity. Further, when resin coated carrier particles are prepared by the powder coating process, the majority of the coating materials are fused to the carrier surface thereby reducing the number of toner impaction sites on the carrier material.

Powder coating processes typically utilize polymers in the form of fine powders which can be mixed and properly coat the carrier core. The triboelectric charging value of the aforementioned carriers can be controlled by the polymer or mixture of polymers selected for the coating. The disadvantage of this approach is that only a limited number of polymers are available in the form of fine powders, especially for the preparation of conductive carriers. For example, there is illustrated in U.S. Pat. No. 5,236,629, the disclosure of which is totally incorporated herein by reference, a polymer containing carbon black. Also, it is known to coat the carrier core with a polymer. However, coatings prepared by this method have the tendency to chip or flake off, and fail upon impact, or abrasive contact with machine parts and other carrier particles. These flakes or chips, which cannot readily be reclaimed from the developer mixture, have an adverse effect on the triboelectric charging characteristics of the carrier particles, thereby providing images with lower resolution in comparison to those compositions wherein the carrier coatings are retained on the surface of the core substrate. Furthermore, partially coated carriers have a short life, for example from about 1 to about 30 days, and poor stability.

Other patents of interest include U.S. Pat. No. 3,939,086, which illustrates steel carrier beads with polyethylene coatings, see column 6; U.S. Pat. Nos. 4,264,697, which discloses dry coating and fusing processes; 3,533,835; 3,658,500; 3,798,167; 3,918,968; 3,922,382; 4,238,558; 4,310,611; 4,397,935; 5,015,550; 5,002,846; 4,937,166, and 4,434,220.

Certain ferrite carriers are illustrated in U.S. Pat. Nos. 4,546,060; 4,764,445; 4,855,205, and 4,855,206. In the U.S. Pat. No. 4,855,205 patent there is disclosed a two phase ferrite composite with a spinel or S phase of the formula $MFe_2O_4$ and a magnetoplumbite or M phase. It is indicated in column 3 of this patent that the composites can be prepared by conventional procedures and that the composite can be coated with a polymer well known in the art. Examples of polymers include those as illustrated in U.S. Pat. No. 4,546,060, such as fluorocarbon polymers, like polytetrafluoroethylene, polyvinylidenefluoride, and the like, see column 8.

Also of interest may be U.S. Pat. Nos. 6,361,915 and 6,355,391, which disclose, for example, emulsion polymerization methods for the preparation of polymethylmethacrylate (PMMA) nano powders which may also contain carbon black.

With respect to the prior art, only a small part thereof has been selected and this part may or may not be fully representative of the prior art teachings or disclosures.

The disclosures of each of the above patents are totally incorporated herein by reference. The appropriate carrier cores and polymer coatings of these patents may be selected for the present invention in embodiments thereof.

SUMMARY

It is a feature of the present invention to provide toner and developer compositions with many of the advantages illustrated herein, and which carriers can be generated from a mixture of carriers with dissimilar cores as illustrated herein.

In yet another feature of the present invention there are provided processes for generating carrier particle mixtures with a wide range of a preselected conductivity and a wide range of preselected triboelectric charging values.

Yet another feature of the present invention is to provide conductive and insulative carrier particle mixtures that can be mixed in various proportions to achieve a carrier mixture with a selected desired conductivity.

In yet a further feature of the present invention there are provided carrier particles generated from a mixture of insulating carriers and conductive carriers, and wherein the conductive carrier coating can be generated from a monomer or monomers that, for example, are not in close proximity in the triboelectric series, that is for example, a mixture of monomers from different positions in the triboelectric series, and wherein the resulting coating optionally has incorporated therein, or present therein or thereon a conductive component like a conductive carbon black, such as VULCAN™ carbon black available from Cabot Corporation, and wherein the carrier cores are comprised of a first core of steel and a second core of magnetite.

In still a further feature of the present invention there are provided carrier particles with improved mechanical characteristics, carriers wherein the conductivity thereof is tunable by, for example, adjusting the concentration or amount of insulating and conductive carriers in the mixture and carriers wherein the coating adheres to the core, and wherein there is minimal or no separation of the polymer coating from the core.

In yet another feature of the present invention there are provided heterogeneous carrier compositions comprised of insulating and conductive carriers, and wherein the carrier core is, for example, a metallic or metal oxide core for one carrier and magnetite for another second carrier.

Further, in an additional feature of the present invention there are provided carrier particles wherein the carrier triboelectric charging values are from about 25 to about 70 microcoulombs per gram at the same coating weight as determined by the known Faraday Cage technique.

Aspects of the present invention relate to a carrier comprised of a mixture of a first carrier and a second carrier, and wherein the first carrier is comprised of a rough core and the second carrier is comprised of spherical core; carrier particles comprised of a mixture of first carrier particles with rough steel cores and second carrier particles with iron oxide spherical cores; a process for the preparation of a carrier mixture which comprises the mixing of a carrier comprised of a rough core and a second carrier comprised of a spherical core, and wherein each of the carriers contain a polymer or mixture of polymers thereover; carrier compositions comprised of a mixture of insulating carrier particles and conductive carrier particles; a carrier mixture wherein each of the carriers are coated with a polymer, or wherein each of the carriers are coated with a mixture of polymers, and wherein at least one core is comprised of a rough morphology steel core and a second core of a magnetite; a carrier wherein the carrier mixture is comprised of from about 2 polymers to about 7 polymers, or wherein the mixture is comprised of from 1 to about 4 insulating coated carriers, and from 1 to about 4 of conductive coated carriers; a carrier composition comprised of a first carrier with a core of steel comprised of irregularly shaped particles containing protrusions and dimples with sizes of, for example, from about 1 to about 15 microns for both dimples and protrusions, that is, a rough morphology, and a second carrier with a core of magnetite, and which composition can be mixed with a toner, especially a toner generated by emulsion/aggregation processes, such as U.S. Pat. Nos. 5,290,654, 5,278,020, 5,308,734, 5,370,963, 5,344,738, 5,403,693, 5,418,108, 5,364,729, and 5,346,797. Also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,910,387; 5,919,595; 5,916,725; 5,902,710; 5,863,698, 5,925,488; 5,977,210 and 5,858,60, the disclosures of which are totally incorporated herein by reference; a carrier wherein the spherical carrier has a conductivity of about $10^{-10}$ to about $10^{-8}$ (ohm-cm)$^{-1}$; a carrier wherein the rough carrier has a conductivity of about $10^{-5}$ to about $10^{-8}$ (ohm-cm)$^{-1}$; a carrier wherein the insulating carrier has a conductivity of about $10^{-10}$ to about $10^{-8}$ (ohm-cm)$^{-1}$, and the conducting carrier has a conductivity of about $10^{-5}$ to about $10^{-9}$ (ohm-cm)$^{-1}$; a carrier wherein the insulating carrier has a conductivity of about $10^{-13}$ to about $10^{-15}$ (ohm-cm)$^{-1}$, and the conducting carrier has a conductivity of about $10^{-5}$ to about $10^{-9}$ (ohm-cm)$^{-1}$; a carrier wherein the spherical carrier is comprised of a core of a magnetite and an insulating polymer thereover, and wherein optionally the insulating carrier has a conductivity of from about $10^{-10}$ to about $10^{-8}$ (ohm-cm)$^{-1}$, and wherein the rough carrier is comprised of a core of steel and a polymer thereover, and wherein optionally the conductive carrier has a conductivity of from about $10^{-5}$ to about $10^{-8}$ (ohm-cm)$^{-1}$; a carrier wherein the polymer coating is polymethylmethacrylate, polyvinylidenefluoride, polyvinylfluoride, copolybutylacrylate methacrylate, copolyperfluorooctylethyl methacrylate, methylmethacrylate, or polystyrene, and optionally wherein the coating contains a conductive filler component; a carrier wherein the conductive component is a conductive carbon black, optionally present in an amount of from about 20 to about 70 weight percent, or wherein the conductive component is a metal oxide, a metal, a conductive polymer, or a semiconductor component; a carrier wherein the polymer coating is polymethylmethacrylate, and wherein the core is powdered iron, and magnetite for the second carrier; a carrier wherein the carrier core for the insulating carrier is steel and the carrier core for the conductive carrier is a magnetite; a carrier wherein in the carrier mixture there is present from about 5 to about 95 percent of the insulating carrier and from about 5 to about 95 percent of the conductive carrier, and wherein the total thereof is about 100 percent, or wherein in the mixture there is present from about 35 to about 75 percent of insulating carrier and from about 35 to about 75 percent of conductive carrier, and wherein the total thereof is about 100 percent; a carrier wherein in the mixture there is present from about 40 to about 60 percent of roughened steel carriers and from about 40 to about 60 percent of carriers with a magnetite core, and wherein the total thereof is about 100 percent, and wherein the carriers contain cores that are coated with a polymer, and wherein the polymer encompasses from about 75 to about 100 percent of the core; a carrier wherein the resulting carrier is semiconductive, and wherein the conductivity of the resulting carrier has a value of about $10^{-9}$ to about $10^{-13}$ (ohm-cm)$^{-1}$; a process for the preparation of a carrier which comprises the mixing of carriers, a number of which contain a steel core and a number of which contain a magnetite core; a process wherein the monomer to form the carrier polymer coating is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof, and wherein the monomer is present in an amount of from about 1 to about 5 percent by weight of the carrier core, or wherein the monomer is methyl methacrylate, styrene, trifluoroethyl methacrylate, or mixtures thereof, and wherein the monomer is present in an amount of from about 0.5 to about 10 percent by weight, or from about 1 to about 5 percent by weight of the carrier core, and wherein the initiator for polymerization of the monomer is selected from the group consisting of azo compounds, peroxides, and mixtures thereof, and where the amount of the initiator is from about 0.1 to about 20 percent by weight, or from about 0.5 to about 10 percent by weight of the monomer mixture; a carrier mixture wherein the carries contain a core of a diameter of from about 30 to about 100 microns; a carrier wherein the coating polymer is polyvinylidenefluoride, polyethylene, polymethylmethacrylate, polytrifluoroethylmethacrylate, copolyethylene vinylacetate, copolyvinylidenefluoride, tetrafluoroethylene, polystyrene, tetrafluoroethylene, polyvinyl chloride, polyvinyl acetate, or mixtures thereof, and optionally wherein the coating contains a conductive filler component; a carrier mixture wherein each of the polymer coatings is present in a total amount of from about 0.5 to about 10 percent by weight of the carrier, or from about 1 to about 5 percent by weight of the carrier, and optionally wherein there results a semiconductive carrier with a conductivity of about $10^{-9}$ to about $10^{-13}$ (ohm-cm)$^{-1}$; a developer comprised of the carrier mixture illustrated herein and toner; a carrier wherein each of the coated carrier contains a polymer coating of polymethylmethacrylate, polystyrene, polytrifluoroethylmethacrylate, polyvinylidene fluoride, or mixtures thereof, or wherein each of the carriers comprises a polymer coating comprised of a mixture of polymethylmethacrylate and polytrifluoroethylmethacrylate; heterogeneous carrier compositions comprised of a mixture of an insulating carrier and a conductive carrier, wherein the amount of insulating carrier selected is, for example, from about 1 to about 99, and more specially, from about 35 to about 75 weight percent, and the amount of conductive carrier selected is, for example, from about 1 to about 99, and more specifically, from about 35 to about 75 weight percent, and wherein the amount of the insulating carrier and the amount of the conductive carrier totals, about 100 percent; a carrier composition wherein the core diameter is about 30 to about 100 microns as measured by a Malvern laser diffractometer; a carrier composition wherein the core is iron, steel or a ferrite, such as an iron ferrite, strontium ferrite, and the like; a carrier mixture comprised of a steel core and a magnetite core and thereover each core, for example, from about 1 to about 99 parts of a first polymer coating and from about 99 to about 1 of a second polymer coating, and wherein the total thereof is about 100 percent, and wherein the polymer coating is present in an amount of from about 0.5 to about 99 percent by weight of each carrier, and when selected a conductive component present in an amount of from about 10 to about 70 percent by weight of the polymer coating; wherein the conductive component is present in an amount of from about 20 to about 50 percent by weight of the polymer coating; a carrier composition containing a carrier with a conductivity of from about $10^{-15}$ to about $10^{-6}$ (ohm-cm)$^{-1}$; a carrier mixture with a triboelectric charge value of from about −80 to about 80 microcoulombs/gram and a semiconductivity of from about $10^{-12}$ to about $10^{-9}$ $(ohm\text{-}cm)^{-1}$; a process for the preparation of carriers comprising the mixing of carrier cores of steel with a rough morphology and magnetite with a monomer and initiator, optional chain transfer agent, polymerizing the monomer by heating thereby resulting in a polymer contained on each of the carrier surfaces, and thereafter for the conductive carrier adding a conductive component, and optionally drying; a process wherein a monomer mixture is heated at a temperature of from about 50° C. to about 95° C., or from about 60° C. to about 85° C.; a process wherein the monomer mixture is heated for a period of from about 30 minutes to about 5 hours, or from about 30 minutes to about 3 hours; a process wherein the monomer is selected from the group consisting of styrene, α-methyl styrene, p-chlorostyrene, monocarboxylic acids and the derivatives thereof; dicarboxylic acids with a double bond and derivatives thereof; vinyl ketones; vinyl naphthalene; unsaturated mono-olefins; vinylidene halides; N-vinyl compounds; fluorinated vinyl compounds; and mixtures thereof; a process wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate, and mixtures thereof; a process wherein the monomer is methyl methacrylate, styrene, trifluoroethyl methacrylate, or mixtures thereof, wherein the conductive additive is a carbon black, and where the amount of the conductive additive present is from about 10 to about 70 percent by weight, or from about 20 to about 50 percent by weight; a process wherein the initiator is selected from the group consisting of azo compounds, peroxides, and mixtures thereof, and where the amount of the initiator is from about 0.1 to about 20 percent by weight, or from about 0.5 to about 10 percent by weight of the monomer mixture; a process wherein the initiator is selected from the group consisting of 2,2'-azodimethylvaleronitrile, 2,2'-azoisobutyronitrile, azobiscyclohexanenitrile, 2-methylbutyronitrile, benzoyl peroxides, lauryl peroxide, 1-1-(t-butylperoxy)-3,3,5-trimethylcyclohexane, n-butyl-4,4-di-(t-butylperoxy)valerate, dicumyl peroxide, and mixtures thereof; a process wherein the chain transfer agent is selected from the group consisting of mercaptans and halogenated hydrocarbons, and wherein the chain transfer agent is selected in an amount of from about 0.01 to about 1 percent by weight, or from about 0.05 to about 0.5 percent by weight of the monomer mixture; and a process wherein the chain transfer agent is selected from the group consisting of laurylmercaptan, butylmercaptan carbon tetrachloride, carbon tetrabromide and mixtures thereof; and a developer comprised of conductive carrier particles and toner.

Examples of the first carrier include those with a core of steel, especially steel with a rough or roughed nonsmooth surface, and which core is nonspherical in shape, possesses irregular characteristics, and is of a diameter of from about 45 to about 120 microns and preferably about 65 microns, and preferably coated with a polymer or mixture of polymers, and more specifically, coated with a polymethylmethacrylate at a percentage of from, for example, about 0.5 to about 2 percent available from Hoeganaes, Quebec Metals; irregularly shaped Sr-ferrites or magnetites, and the like, and wherein the polymer coating weight is, for example, from about 0.1 to about 5 weight percent, and more specifically, from about 0.5 to about 1.5 weight percent, and also wherein a conductive component, such as a conductive carbon black (CB), can be present in the polymer coating and which component can be selected in an amount of coating from 0.5 percent to about 50 weight percent, and more specifically, from about 9 to about 25 weight percent and which component can increase the carrier conductivity from, for example, about $10^{-9}$ without CB to about $10^{-7}$ with 20 percent CB, and decrease the carrier triboelectric charge from, for example, about 30 $\mu$C/g to about 15 $\mu$C/g. Examples of the second carrier include those with a core of magnetite, especially a spherically shaped magnetite, and which core is available from Höganäs (Sweden) as "CM grade", and which core is spherical in shape, and is of a diameter of from about 35 to about 90 microns and preferably about 65 microns, and preferably coated with a polymer or mixture of polymers, and more specifically, coated with a polymethylmethacrylate at a percentage of from, for example, about 0.5 to about 2 percent, and wherein the magnetites can be obtained from Höganäs, such as $Fe_3O_4$, of a diameter of about 40 to about 85 microns, and in embodiments from about 5 about 30 weight percent of $Fe_3O_4$, and wherein the coating weight is, for example, from about 0.4 to about 2 weight percent, and more specifically, wherein the coating is a poly-methyl-methacrylate containing about 10 to about 40 weight percent of a suitable CB. For each of the carrier coatings there can be selected a single polymer or a mixture of polymer coatings, for example, not in close proximity in the triboelectric series wherein close proximity refers to the choice of the polymers selected as dictated by their position in the triboelectric series, therefore, for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polymethylmethacrylate, has a triboelectric charging value of about 40 microcoulombs per gram. More specifically, not in close proximity refers to first and second polymers that are at different electronic work function values, that is the polymers are not at the same electronic work function value. and further, the first and second polymers are comprised of different components. Additionally, the difference in electronic work functions in embodiments between the first and second polymer is, for example, at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, *Polymer Science,* A. D. Jenkins, Editor, North Holland Publishing (1972), the disclosure of which is totally incorporated herein by reference.

The percentage of each polymer present as the carrier coating mixture can vary depending on the specific components selected, the coating weight and the properties desired. Generally, the coated polymer mixtures contains from about 50 to about 100 percent of a first polymer, and from about 0 to about 50 percent by weight of a second polymer. Preferably, there are selected mixtures of polymers with from about 85 to about 95 percent by weight of a first polymer, and from about 5 to about 15 percent by weight of a second polymer.

There results, in accordance with aspects of the present invention, carrier particles of relatively constant conductivities, measured by the 2-probe current-voltage DC method of from about $10^{-15}$ to about $10^{-2}$ (ohm-cm)$^{-1}$, about $10^{-10}$ to about $10^{-7}$ (ohm-cm)$^{-1}$ at, for example, a voltage of about 10 volts, applied to a magnetic brush formed on a magnetic roller containing approximately 30 to 100 grams of carrier with a gap between electrodes of ~0.1 centimeter, and wherein the carrier particles are of a triboelectric charging value of from about −80 to about 80 microcoulombs per gram, and more specifically, from about −60 to about 60 microcoulombs per gram as determined by a Faraday Cage, these parameters being dependent on the carrier coatings selected, and the percentage of each of the polymers used, and the conductive polymer.

When the carrier comprises a mixture of rough steel core carrier particles and iron oxide spherical carrier particles and the rough steel core particles are irregularly shaped with an average diameter size of about 35 to about 120 microns containing protrusions and dimples of about 1 to about 15 microns, the carrier can possess a conductivity of from about $10^{-10}$ to about $10^{5}$ (ohm-cm)$^{-1}$ as measured in a magnetic brush cell. In other embodiments, the carrier can possess a conductivity of about $10^{-7}$ (ohm-cm)$^{-1}$.

Examples of respective carrier cores that can be selected include iron, iron alloys, steel, ferrites, magnetites, nickel, and mixtures thereof. Alloys of iron include iron-silicon, iron-aluminum-silicon, iron-nickel, iron-cobalt, and mixtures thereof. Ferrites include a class of magnetic oxides that contain iron as the major metallic component and optionally a second metallic component, including magnesium, manganese, cobalt, nickel, zinc, copper, and mixtures thereof. Preferred carrier cores include steel, magnetites and mixtures thereof with a volume average diameter of from about 30 to about 120 microns, and preferably from about 40 to about 70 microns as measured by a Malvern laser diffractometer. Examples of monomers or comonomers which can be polymerized to form a coating on the carrier surface in an amount of, for example, from about 0.5 to about 10 percent, and preferably from about 1 to about 5 percent by weight of carrier core include vinyl monomers, such as styrene, p-chlorostyrene, vinyl naphthalene and the like; monocarboxylic acids and their derivatives, such as acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile, acrylamide and trifluoroethyl methacrylate, dicarboxylic acids having a double bond and their derivatives, such as maleic acid, monobutyl maleate, dibutyl maleate, unsaturated monoolefins such as ethylene, propylene, butylene and isobutylene; vinyl halides such as vinyl chloride, vinyl bromide, vinyl fluoride; vinyl esters such as vinyl acetate, vinyl propionate, vinyl benzoate and vinyl butyrate; vinyl ethers inclusive of vinyl methyl ether, vinyl isobutyl ether and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl compounds such as N-vinyl indole and N-vinyl pyrrolidene; fluorinated monomers such as pentafluoro styrene, allyl pentafluorobenzene and the like, other suitable known monomers, and mixtures thereof.

Toners can be admixed with the carrier to generate developers. As one toner resin there can be selected the esterification products of a dicarboxylic acid and a diol comprising a diphenol, reference U.S. Pat. No. 3,590,000, the disclosure of which is totally incorporated herein by reference, reactive extruded polyesters, such as those illustrated in U.S. Pat. No. 5,227,460, the disclosure of which is totally incorporated herein by reference, and the like. Specific toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerythritol. Other toner resins are illustrated in a number of U.S. patents including some of the patents recited hereinbefore.

Generally, from about 1 part to about 5 parts by weight of toner are mixed with from about 10 to about 300 parts by weight of the carrier particles.

Numerous well known suitable colorants, such as pigments or dyes, can be selected as the colorant for the toner including, for example, cyan, magenta, yellow, red, blue, carbon black, nigrosine dye, lamp black, iron oxides, magnetites, and mixtures thereof. The colorant, which is preferably carbon black, should be present in a sufficient amount to render the toner composition highly colored. Thus, the colorant particles can be present in amounts of from about 3 percent by weight to about 20, and more specifically, from about 3 to about 12 weight percent or percent by weight, based on the total weight of the toner composition, however, lesser or greater amounts of colorant particles can be selected. Colorant includes pigment, dye, mixtures thereof, mixtures of pigments, mixtures of dyes, and the like.

When the colorant particles are comprised of magnetites, which are a mixture of iron oxides ($FeO.Fe_2O_3$) including those commercially available as MAPICO BLACK®, they are usually present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin is selected. Generally, the toner composition is comprised of from about 85 percent to about 97 percent by weight of toner resin particles, and from about 3 percent by weight to about 15 percent by weight of colorant particles.

The developer compositions can be comprised of thermoplastic resin particles, the carrier mixture illustrated herein and as colorants, magenta, cyan and/or yellow particles, and mixtures thereof. More specifically, illustrative examples of magentas include 1,9-dimethylsubstituted quinacridone and anthraquinone dye identified in the color index as CI 60720, CI Dispersed Red 15, a diazo dye identified in the color index as CI 26050, CI Solvent Red 19, and the like. Examples of cyans include copper tetra-4 (octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellows are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo4'-chloro-2,5-dimethoxy aceto-acetanilide, permanent yellow FGL, and the like. The colorants, which include pigments, mixtures of pigments, dyes, mixtures of dyes, mixtures of dyes and pigments, and the like, are generally present in the toner composition in an amount of from about 1 weight percent to about 15 weight percent based on the weight of the toner resin particles.

For further enhancing the positive charging characteristics of the developer compositions illustrated herein, and as optional components there can be incorporated therein known charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; metal complexes, E-88™, naphthalene sulfonates, quaternary ammonium compounds; and other similar known charge enhancing additives. These additives are usually incorporated into the toner or carrier coating in an amount of from about 0.1 percent by weight to about 20, and preferably from about 1 to about 7 weight percent by weight.

Examples of imaging members selected for the imaging processes illustrated herein are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,406, the disclosures of which are totally incorporated herein by reference, and other similar layered photoresponsive devices. Examples of generating layers are trigonal selenium, metal phthalocyanines, perylenes, titanyl phthalocyanines, metal free phthalocyanines, hydroxygallium phthalocyanines, and vanadyl phthalocyanines. As charge transport molecules there can be selected, for example, the aryl diamines disclosed in the '990 patent. Also, there can be selected as photogenerating pigments, squaraine compounds, thiapyrillium materials hydroxy gallium phthalocyanine, and the like. These layered members are conventionally charged negatively thus usually requiring a positively charged toner.

Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference, and color, other than black, imaging and digital systems and processors. Images obtained with the developer composition of the present invention in embodiments possessed acceptable solids, excellent halftones and desirable line resolution, with acceptable or substantially no background deposits.

The following Examples are being provided to further illustrate the present invention, it being noted that these Examples are intended to illustrate and not limit the scope of the present invention. Parts and percentages are by weight unless otherwise indicated.

1. Synthesis of Poly(methyl methacrylate) with Carbon Black (PMMA/CB)

To a 1 liter stainless steel Parr reactor were added 100.9 grams of methyl methacrylate (MMA), 538.2 grams of toluene, 7.23 grams of azobis(cyanohexane) (VAZO-88™), 1.69 grams of benzoyl peroxide (LUCIDOL 75™), and 152 grams of CONDUCTEX SC ULTRA™ carbon black obtained from Columbian Chemicals Company. The reactor was stirred with a pitch blade impeller at 230 rpm. The temperature was raised to 95° C. and held for 6 hours, followed by a temperature ramp of 0.14° C./minute to 110° C. The reactor was then cooled to room temperature, about 25° C. The reactor contents were poured into a foil tray and toluene was evaporated by air drying. The resulting dry material was ground with a coffee mill, and further dried in a vacuum dryer at 80° C. for 6 hours. The resulting polymethyl-methacrylate/carbon black PMMA/CB copolymer (SOLP) was in the form of a coarse, sandy powder, which contained 59.6 weight percent carbon black, 39.8 weight percent polymer, and 0.6 weight percent volatiles as measured by thermogravimetric analysis (TGA).

To a 500 milliliter glass reactor were added 95 grams of MMA (methylmethacrylate), 0.6 gram of divinylbenzene and 45 grams of SOLP as prepared above. The resulting mixture was stirred with a pitch blade impeller at 200 rpm for 15 hours. To this mixture were added 4.1 grams of 2,2'-azobis(2,4-dimethylvaleronitrile) (VAZO-52™), 2.1 grams of 2,2'-azobis-2methyl-butanenitrile (VAZO-67™), and 2.9 grams of benzoyl peroxide (LUCIDOL 75™). Stirring was continued at 200 rpm for 2 hours. 150 Grams of this mixture were then added to a mixture of 439.6 grams of deionized water, 15.4 grams of polyvinyl alcohol (AIRVOL 603™), and 5 grams of potassium iodide. The resulting mixture was stirred for 2 minutes at 200 rpm with a pitch blade impeller, followed by homogenizing at 800 rpm for 5 minutes with a Brinkmann Polytron. The resulting mixture was charged into a 1 liter Parr reactor and stirred at 230 rpm with a pitch blade impeller. The temperature was raised to 60° C. and held there for 1.5 hours, and then raised to 80° C. and held for 1.5 hours. The reactor was then cooled to room temperature. The final slurry was added to a mixture of 406 grams of methanol and 46 grams of deionized water, centrifuged at 3,000 rpm for 3 minutes, and decanted. The resulting wet cake was washed three more times in this manner, followed by a final wash with 900 grams of deionized water. The final wet cake was vacuum dried at 80° C. and then ground with a coffee mill. The final product was comprised of a PMMA/CB (polymethyl methacrylate/carbon black) polymer in the form of a fine talc-like black powder. The composition of this polymer by TGA (thermographic analysis) was 21.5 weight percent carbon black, 77.7 weight percent of the above polymer, and 0.8 weight percent volatiles.

2. Emulsion Polymerization of Poly(methyl methacrylate) with Carbon Black (PMMA/CB) in the Presence of Sodium Lauryl Sulfate as a Surfactant:

This polymerization was accomplished as illustrated in U.S. Pat. Nos. 6,361,915 and 6,355,391, the disclosures of which are totally incorporated herein by reference, and wherein there resulted, for example, a poly(methyl methacrylate) powder with an average diameter particle size of, for example, from about 40 nanometers to about 200 nanometers containing, for example, a sodium lauryl sulfate in an amount of from about 0.5 to about 2 weight percent or the powder can be comprised of a homogeneous mixture in an amount of, for example, from about 1 to about 60 percent by weight.

CARRIER COMPARATIVE EXAMPLE I

A conductive carrier comprised of a rough-morphology steel core (Hoeganaes) with an average particle size diameter of 65 microns, and 1 weight percent coating of 80 percent polymethylmethacrylate and 20 percent carbon black was prepared as illustrated herein. To measure carrier conductivity, a magnetic brush cell was used (reference the known standard Gutman cell). A voltage of 10 volts was applied to a magnetic brush of the carrier, and the current was measured. The resultant conductivity was $3.8\times10^{-8}$ $(\text{ohm-cm})^{-1}$.

DEVELOPER COMPARATIVE EXAMPLE II

The rough carrier in Example I was mixed with 4 pph of black toner used in the Xerox Corporation DC1632/2240 printer and available from Xerox Corporation under Part Number 006R01122, and which toner contains a resin, colorant, and toner additives.

Developer conductivity was measured using the method of Example I and was $4.5\times10^{-9}$ (ohm-cm)$^{-1}$. 800 Grams of this developer were placed into a Xerox Corporation DC265 developer housing in a Xerox DC265 printer, which has HJD (hybrid jumping development) development. The DC265 was set in an open-loop mode. DMA was measured by vacuuming a 1"×1" developed solid area toner patch off the photoreceptor. Then the developer was aged in a no throughput regime by printing 1,000 blank images. Nominal DC development bias corresponded to DMA=0.55 mg/cm$^2$ at a constant AC donor roll voltage of 2,225 volts. Reload was determined by printing a reload pattern. The reload pattern was comprised of a solid-area right triangle with a 14 centimeter leg parallel to the inboard-outboard direction, a 10 centimeter leg parallel to the process direction, and the hypotenuse facing the lead edge of the print; and a 50 percent halftone 14×10 centimeter rectangle attached to the longer leg of the triangle. The reload defect appears in the halftone area as a shadow of the solid area triangle at the distance that equals one full circumference of the donor roll. Reload was measured by measuring the increase in L* in the reload area with respect to the area unaffected by the reload defect. The target values are <3 for the increase in L* due to reload, and <300 volts for development bias.

In this Example, the development bias to achieve DMA of 0.55 was 300 volts before aging and 450 volts after aging (too high). Reload was 0.6. Deficient reload appeared upon printing large solid area images as fading of the solid or half-tone area after one full revolution of the donor roll. Typically, a change of lightness (L*) by about 2 to about 20, and more specifically, about 3 to about 5 are visible to a naked eye, and thus can constitute a print defect.

CARRIER EXAMPLE III 2,500 Grams of a spherical magnetite core with a mean particle size of 65 microns available from Höganäs AB (Sweden) was mixed with 32.5 grams of PMMA/CB polymer containing 20 percent carbon black (CB) and 80 percent PMMA produced by the process described above (see "Synthesis of Poly(methyl methacrylate) with Carbon Black"). Mixing was conducted at 145 RPM for 10 minutes. The resulting premix was fused at 205° C. (see U.S. Pat. No. 6,051,354, the disclosure of which is totally incorporated herein by reference). Conductivity of the resulting carrier was measured using the method of Example I and was $7.5\times10^{-9}$ (ohm-cm)$^{-1}$.

DEVELOPER EXAMPLE IV

A developer was prepared by mixing the carrier of Example III with 4 pph of the toner of Example II. The conductivity of this developer was $9.6\times10^{-11}$ (ohm-cm)$^{-1}$, i.e., this developer was insufficiently conductive. Development potential was 120 volts before aging, and 170 volts after aging. This developer evidenced better developability (i.e., lower development potential) than the developer in Example III, and better stability in view of no throughput aging (i.e., smaller increase of development potential after aging). This improvement is due to the spherical shape of the carrier in this developer. The reload was too high (5).

CARRIER MIXTURE DEVELOPER EXAMPLE V

30 Percent by weight of the spherical carrier of Example III and 70 weight percent of the rough carrier of Comparative Example I were mixed. The resulting carrier mixture was mixed with 4 pph of the toner of Example II. The resulting developer had a reload of 2.7, and the development potential was 170 volts before aging and 270 volts after aging.

CARRIER EXAMPLE VI

A commercially available 40 micron spherical magnetite core CM-40 obtained from Höganäs AB (Sweden) was powder coated with 0.3 weight percent of a coating polymer containing 70 percent PMMA prepared by emulsion polymerization (U.S. Pat. No. 6,361,915, the disclosure of which is totally incorporated herein by reference) and 30 percent CB by cold blending followed by ZSK30 extrusion at 205° C.

CARRIER MIXTURE DEVELOPER EXAMPLE VII

10 Weight percent of the spherical carrier of Example VI and 90 weight percent of the rough carrier of Comparative Example I were mixed. The resulting carrier mixture was mixed with 4 pph of the toner of Example II. The resulting developer had a reload of 1.4 volts, and a development potential of 180 volts.

CARRIER MIXTURE DEVELOPER EXAMPLE VIII

20 Weight percent spherical of the carrier of Example VI and 80 weight percent of the rough carrier of Comparative Example I were mixed. The resulting carrier mixture was mixed with 4 pph of the toner of Example II (black toner used in the Xerox Corporation DC1632/2240 printer and available from Xerox Corporation under Part Number 006R01122). The resulting developer had a reload of 2, and a development potential of 165 volts.

CARRIER MIXTURE DEVELOPER EXAMPLE IX

25 Weight percent of the spherical carrier of Example VI and 75 weight percent of the rough carrier of Comparative Example I were mixed. The resulting carrier mixture was mixed with 4 pph of the toner of Example II. The resulting developer had a high (the concentration of spherical carrier was high) reload of 3.4, and a development potential of 150 volts.

The table below provides a summary of data for Developer Examples II, IV, V, VII, VIII, and IX. The numbers in bold italic correspond to unacceptable values of reload (i.e., Delta L* greater than 3) or development bias (i.e., DC potential at donor roll with a zero-potential reference as magnetic roll is greater than 300 volts). Q/m (tribo charge) is quoted for each Example. There is very little effect of spherical-to-rough component ratio on toner charge. Also, it appears that the maximum amount of spherical component that can be allowed without exceeding the reload limit is higher for 65 micron spherical core than for 40 micron core.

| Example | Spherical Carrier, wt. % | Size, μm | Rough Carrier, wt. % | V dev (DC) (target <300 V) | V dev (DC) after aging | Reload Delta L* (target <2) | ZTP aged | Q/M, μC/g | Q/M, μC/g after aging |
|---|---|---|---|---|---|---|---|---|---|
| IV | 100 | 65 | 0 | 120 | 175 | 5.0 | | 28.60 | 30.00 |
| V | 30 | 65 | 70 | 175 | 270 | 2.70 | | 29.00 | |
| II | 0 | 65 | 100 | ***300*** | ***450*** | 1.50 | | 30.00 | 43.80 |
| VII | 10 | 40 | 90 | 185 | | 1.38 | | 45.00 | |
| VIII | 20 | 40 | 80 | 175 | | 2.00 | | 27.30 | |
| IX | 25 | 40 | 75 | 150 | | ***3.37*** | | 27.90 | |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A carrier comprised of a mixture of first rough steel core carrier particles and second iron oxide spherical carrier particles, wherein said rough steel core carrier particles are comprised of irregularly shaped steel with an average diameter size of about 35 to about 120 microns containing protrusions and dimples of about 1 to about 15 microns and wherein said carrier possesses a conductivity of about $10^{-7}$ $(\text{ohm-cm})^{-1}$ as measured in a magnetic brush cell.

2. A carrier in accordance with claim 1 wherein said mixture is a homogeneous mixture of said first carrier particles and said second carrier particles.

3. A carrier in accordance with claim 1 wherein each of said carrier particles are coated with a polymer, or wherein each of said carrier particles is coated with a mixture of polymers.

4. A carrier in accordance with claim 3 wherein said mixture of polymers is comprised of from about 2 polymers to about 7 polymers.

5. A carrier in accordance with claim 3 wherein said mixture of polymers is comprised of two polymers.

6. A carrier in accordance with claim 3 wherein said polymer is selected from the group consisting of polymethylmethacrylate, polyvinylidenefluoride, polyvinylfluoride, copolybutylacrylate methacrylate, copolyperfluorooctylethyl methacrylate, methylmethacrylate, and polystyrene.

7. A carrier in accordance with claim 6 wherein said polymer contains a conductive component of carbon black present in an amount of from about 20 to about 70 weight percent, or wherein said conductive component is a metal oxide, a metal, or a conductive polymer.

8. A carrier in accordance with claim 3 wherein each of said carrier particles is coated with polymethylmethacrylate.

9. A carrier in accordance with claim 3 wherein said mixture of polymers is a mixture comprising polymethylmethacrylate and polyvinylidene fluoride.

10. A carrier in accordance with claim 1 wherein said iron oxide is an iron oxide of a magnetite, a ferrite or a hematite.

11. A carrier in accordance with claim 1 wherein said first carrier particles are present in an amount of from about 80 to about 90 percent, and said second carrier particles are present in an amount of from about 20 to about 10 percent, and wherein the total thereof is about 100 percent.

12. A carrier in accordance with claim 1 wherein said first carrier particles and said second carrier particles are of the same or similar size.

13. A carrier in accordance with claim 1 wherein said first carrier particles have a diameter of from about 50 to about 80 microns, and said second carrier particles have a diameter of from about 50 to about 80 microns.

14. A carrier in accordance with claim 1 wherein said first carrier particles have a diameter of about 65 microns, and said second carrier particles have a diameter of about 65 microns.

15. A carrier in accordance with claim 1 wherein said first carrier particles have a diameter of from about 60 to about 80 microns, and said second carrier particles have a diameter of from about 50 to about 80 microns.

16. A carrier in accordance with claim 1 wherein said second carrier particles contain a polymer coating.

17. A carrier in accordance with claim 1 wherein said first carrier particles contain a polymer coating of polymethylmethacrylate, and said second carrier particles contain a polymer coating of polymethylmethacrylate.

18. A carrier in accordance with claim 17 wherein said coating polymer weight for said first carrier particles is from about 1 to about 4 weight percent and said coating polymer weight for said second carrier particles is from about 1 to about 4 weight percent.

19. A carrier in accordance with claim 17 wherein said coating polymer weight for said first carrier particles is from about 0.05 to about 2 percent, and said coating weight for said second carrier particles is from about 0.05 to about 1.5 weight percent, or wherein said coating polymer weight for said first carrier particles is about 1.3 percent, and said coating weight for said second carrier particles is 1 weight percent.

20. A developer comprised of the carrier of claim 1 and toner.

* * * * *